US009717380B2

(12) United States Patent
Krebs et al.

(10) Patent No.: US 9,717,380 B2
(45) **Date of Patent: *Aug. 1, 2017**

(54) VACUUM CLEANER

(71) Applicant: BISSELL Homecare, Inc., Grand Rapids, MI (US)

(72) Inventors: Alan J. Krebs, Pierson, MI (US); Joseph A. Fester, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/874,680

(22) Filed: Oct. 5, 2015

(65) Prior Publication Data

US 2016/0022103 A1 Jan. 28, 2016

Related U.S. Application Data

(63) Continuation of application No. 13/545,500, filed on Jul. 10, 2012, now Pat. No. 9,149,165.

(60) Provisional application No. 61/608,288, filed on Mar. 8, 2012.

(51) Int. Cl.

| | |
|---|---|
| ***A47L 5/28*** | (2006.01) |
| ***A47L 9/16*** | (2006.01) |
| ***A47L 9/19*** | (2006.01) |
| ***A47L 9/14*** | (2006.01) |
| ***A47L 5/22*** | (2006.01) |

(52) U.S. Cl.

CPC ..... *A47L 5/28* (2013.01); *A47L 5/225* (2013.01); *A47L 9/14* (2013.01); *A47L 9/165* (2013.01); *A47L 9/1691* (2013.01); *A47L 9/19* (2013.01)

(58) Field of Classification Search

CPC ..... A47L 5/28; A47L 5/38; A47L 9/12; A47L 9/14; A47L 9/165; A47L 9/19; A47L 9/1691; A47L 9/127

See application file for complete search history.

(56) References Cited

U.S. PATENT DOCUMENTS

| | | | |
|---|---|---|---|
| 1,145,047 | A | 7/1915 | Wiedemann et al. |
| 2,133,141 | A | 10/1938 | Holm-Hansen |
| 2,210,953 | A | 8/1940 | Replogle |
| 2,539,195 | A | 1/1951 | Lang |

(Continued)

FOREIGN PATENT DOCUMENTS

| | | | |
|---|---|---|---|
| CN | 1255318 | A | 6/2000 |
| CN | 1442109 | A | 9/2003 |

(Continued)

OTHER PUBLICATIONS

Examiner Huang Xianxin, Photoelectrical Technology Invention Examination Department of Patent Examination Cooperation Center, Notification of the First Office Action, 7 pages, May 4, 2016, Guangdong.

(Continued)

*Primary Examiner* — Dung Van Nguyen

(74) *Attorney, Agent, or Firm* — McGarry Bair PC

(57) ABSTRACT

A vacuum cleaner includes a dirt separating and collecting system. The dirt separating and collecting system can include an air-permeable filter material, and a helical inlet guide. Dirt entering the helical inlet guide within a working airstream is visible to the user through an at least partially transparent housing.

20 Claims, 10 Drawing Sheets

(56) References Cited

U.S. PATENT DOCUMENTS

| | | | |
|---|---|---|---|
| 2,684,232 | A | 7/1954 | Caldwell |
| 2,935,158 | A | 5/1960 | Braun |
| 3,180,071 | A | 4/1965 | Nolte |
| 3,320,727 | A | 5/1967 | Farley et al. |
| 3,636,681 | A | 1/1972 | Batson et al. |
| 3,850,816 | A | 11/1974 | Koch |
| 3,988,132 | A | 10/1976 | Oranje |
| 4,216,563 | A | 8/1980 | Cyphert |
| 4,262,384 | A | 4/1981 | Bowers |
| 4,287,635 | A | 9/1981 | Jacobs |
| 4,314,385 | A | 2/1982 | Wimsatt et al. |
| 4,581,050 | A | 4/1986 | Krantz |
| 5,090,976 | A | 2/1992 | Dyson |
| 5,145,499 | A | 9/1992 | Dyson |
| 5,400,465 | A | 3/1995 | Bosses et al. |
| 5,779,745 | A | 7/1998 | Kilstrom |
| 5,935,279 | A | 8/1999 | Kilstrom |
| 6,083,292 | A | 7/2000 | Fumagalli |
| 6,178,590 | B1 | 1/2001 | Lindsay, III et al. |
| 6,243,912 | B1 | 6/2001 | Grey |
| 6,428,589 | B1 | 8/2002 | Bair et al. |
| 6,485,536 | B1 | 11/2002 | Masters |
| 6,553,610 | B1 | 4/2003 | Shideler |
| 6,732,406 | B2 | 5/2004 | Oh |
| 6,735,816 | B2 | 5/2004 | Oh et al. |
| D495,347 | S | 8/2004 | Erbach |
| 6,792,647 | B2 | 9/2004 | Park et al. |
| 6,868,578 | B1 | 3/2005 | Kasper et al. |
| 6,934,994 | B2 | 8/2005 | Oh et al. |
| 6,948,212 | B2 | 9/2005 | Oh et al. |
| 6,991,667 | B2 | 1/2006 | Yang et al. |
| 7,143,469 | B2 | 12/2006 | Moine et al. |
| 7,162,770 | B2 | 1/2007 | Davidshofer |
| 7,171,725 | B2 | 2/2007 | Sjoberg et al. |
| 7,181,803 | B2 | 2/2007 | Park et al. |
| 7,191,490 | B2 | 3/2007 | Lee et al. |
| 7,343,643 | B2 | 3/2008 | Kondo |
| 7,404,231 | B2 | 7/2008 | Kang |
| 7,419,523 | B2 | 9/2008 | Sjoberg et al. |
| 7,581,287 | B2 | 9/2009 | Yacobi |
| 7,615,109 | B2 | 11/2009 | Sepke et al. |
| 7,637,973 | B2 | 12/2009 | Oh et al. |
| 7,645,311 | B2 | 1/2010 | Oh et al. |
| 7,662,200 | B2 | 2/2010 | Knuth et al. |
| 7,708,789 | B2 | 5/2010 | Fester |
| 7,717,973 | B2 | 5/2010 | Oh et al. |
| 7,722,709 | B2 | 5/2010 | Conrad |
| 7,740,675 | B2 | 6/2010 | Conrad |
| 7,740,707 | B2 | 6/2010 | Bertram et al. |
| 7,744,683 | B2 | 6/2010 | Zhang |
| 7,776,121 | B2 | 8/2010 | Yun et al. |
| 7,811,349 | B2 | 10/2010 | Nguyen |
| 7,931,740 | B2 | 4/2011 | Al-Alusi et al. |
| 7,955,404 | B2 | 6/2011 | Lin |
| 8,032,983 | B2 | 10/2011 | Griffith et al. |
| 8,062,398 | B2 | 11/2011 | Luo et al. |
| 8,176,597 | B2 | 5/2012 | Stein et al. |
| 8,424,153 | B2 | 4/2013 | Fester et al. |
| 8,495,788 | B2 | 7/2013 | Tran |
| 8,997,310 | B2 * | 4/2015 | Davidshofer ..... A47L 9/1608 15/327.2 |
| 9,149,165 | B2 * | 10/2015 | Krebs ..... A47L 5/28 |
| 2003/0182757 | A1 * | 10/2003 | Sepke ..... A47L 5/28 15/353 |
| 2004/0045124 | A1 | 3/2004 | Lindquist et al. |
| 2005/0138763 | A1 * | 6/2005 | Tanner ..... A47L 9/165 15/353 |
| 2006/0236663 | A1 | 10/2006 | Oh |
| 2008/0047091 | A1 | 2/2008 | Nguyen |
| 2008/0196366 | A1 | 8/2008 | Conrad |
| 2008/0264015 | A1 | 10/2008 | Oh et al. |
| 2009/0119870 | A1 | 5/2009 | Nilsson |
| 2011/0219574 | A1 * | 9/2011 | Conrad ..... A47L 9/1683 15/347 |
| 2014/0208536 | A1 * | 7/2014 | Ni ..... A47L 5/28 15/319 |
| 2015/0040343 | A1 * | 2/2015 | Theising ..... A47L 9/1445 15/347 |

FOREIGN PATENT DOCUMENTS

| | | | |
|---|---|---|---|
| CN | 1471891 | A | 2/2004 |
| CN | 1572221 | A | 2/2005 |
| CN | 1788669 | A | 6/2006 |
| CN | 102133077 | A | 7/2011 |
| CN | 202821202 | U | 3/2013 |
| DE | 27 38 850 | A1 | 3/1979 |
| DE | 102004063214 | A1 | 7/2006 |
| EP | 1440651 | A2 | 7/2004 |
| GB | 205155 | | 7/1922 |
| GB | 934293 | | 8/1963 |
| GB | 1 418 010 | | 12/1975 |
| GB | 2 214 104 | A | 8/1989 |
| GB | 2 391 165 | A | 4/2004 |
| JP | 2003-24826 | A | 1/2003 |
| JP | 2006068040 | A | 3/2006 |
| JP | 2006325883 | A | 12/2006 |
| WO | 97/12660 | | 4/1997 |
| WO | 98/35601 | | 8/1998 |
| WO | 98/35602 | | 8/1998 |
| WO | 98/35603 | | 8/1998 |
| WO | 00/74547 | A1 | 12/2000 |
| WO | 03075731 | A1 | 9/2003 |
| WO | 2004008933 | A1 | 1/2004 |
| WO | 2009/104959 | A1 | 8/2009 |

OTHER PUBLICATIONS

Huang Xianxin, English language Notification of Second Office Action, The State Intellectual Property Office of the People's Republic of China issued Dec. 5, 2016, 8 pages.

* cited by examiner

VACUUM CLEANER

CROSS-REFERENCE TO RELATED APPLICATIONS

This application is a continuation of U.S. patent application Ser. No. 13/545,500, filed Jul. 10, 2012, now U.S. Pat. No. 9,149,165, issued Oct. 6, 2015, which claims the benefit of U.S. Provisional Patent Application No. 61/608,288, filed Mar. 8, 2012, both of which are incorporated herein by reference in their entirety.

BACKGROUND

Upright vacuum cleaners employ a variety of dirt separators to remove dirt and debris from a working air stream. Some upright vacuum cleaners employ cyclone separators. Some cyclone separators use one or more frusto-conical-shaped separator(s) and others use high-speed rotational motion of the air/dirt to separate the dirt by centrifugal force. Typically, working air enters and exits at an upper portion of the cyclone separator as the bottom portion of the cyclone separator is used to collect debris. Before exiting the cyclone separator, the working air may flow through an exhaust grill. The exhaust grill can have perforations, holes, vanes, or louvers defining openings through which air may pass.

Upright vacuum cleaners can also employ filter bag separators. Typically, working air is either forced through or drawn through an air permeable filter bag leaving the debris entrained in the working air path inside the filter bag.

BRIEF SUMMARY

According to one aspect of the invention, a vacuum cleaner comprises a body having a suction nozzle, a dirt separating and collecting system provided on the body comprising a housing defining a chamber with an air inlet and an air outlet, an air-permeable filter material removably mounted within the chamber to separate and collect dirt from a working air stream passing from the air inlet to the air outlet, the filter material fluidly disposed between the air inlet and the air outlet such that the working air stream passes through the filter material after passing through the air inlet and before passing through the air outlet, and a helical inlet guide disposed within the housing and directing the working air stream from the air inlet through the filter material along a helical pathway, and a suction source fluidly connected to the suction nozzle and to the air inlet for establishing and maintaining a dirt-containing working air-stream from the suction nozzle to the chamber, wherein the housing is at least partially transparent to permit the helical inlet guide to be viewed from the exterior of the vacuum cleaner.

DETAILED DESCRIPTION

The invention relates to vacuum cleaners and vacuum cleaner systems. In one of its aspects, the invention relates to a vacuum cleaner system that can receive different filter modules. In another aspect, the invention relates to an improved filter bag inlet for a dirt separating and collecting system. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
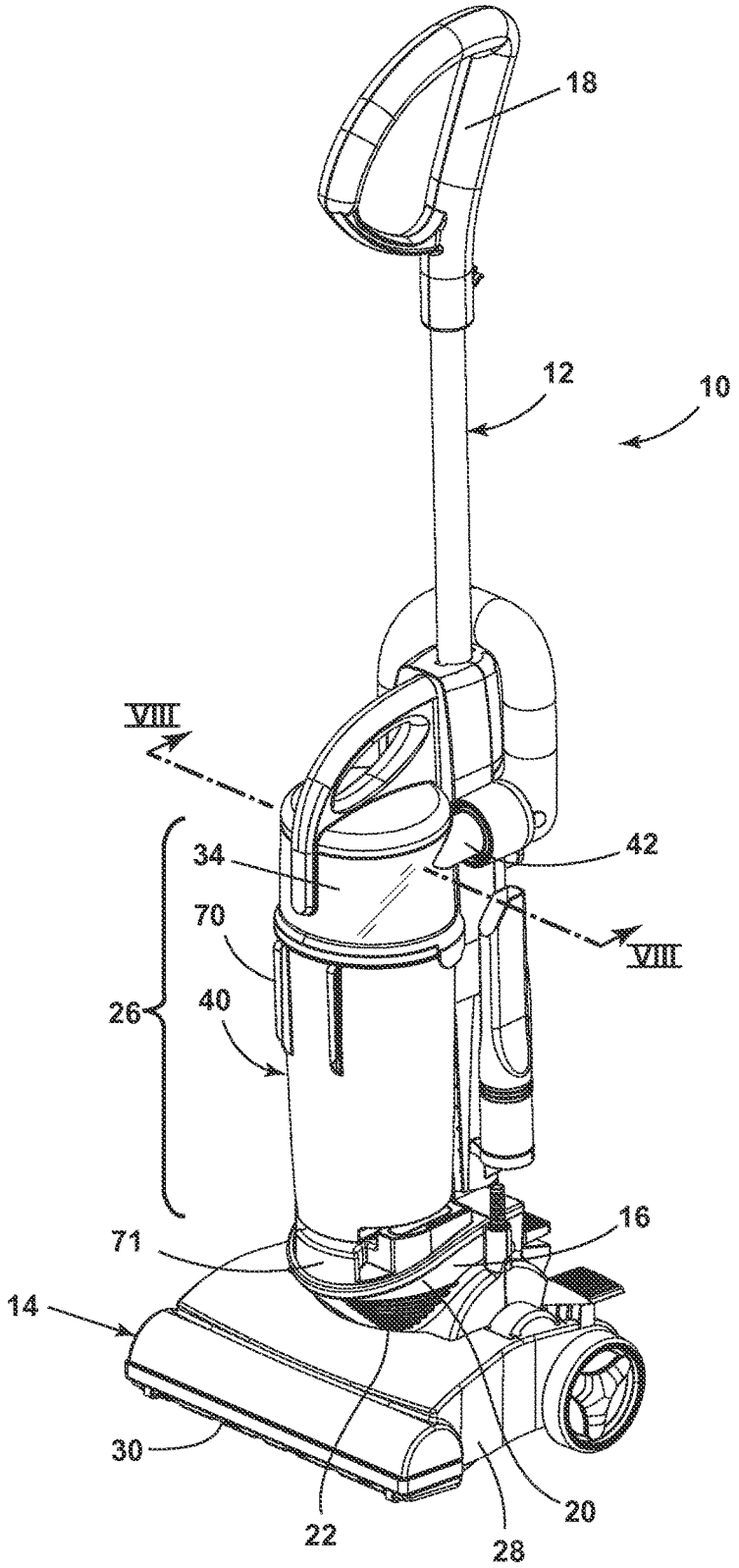
FIG. 1 is a perspective view of a vacuum cleaner having a dirt separation module assembly according to a first embodiment of the invention.

Referring to the drawings, and in particular to FIG. 1, an upright vacuum cleaner 10 comprises an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 to contain a conventional suction source such as a vacuum fan/motor assembly (not shown) oriented transversely therein. A filter housing 22 is formed above the motor cavity 20 and is in fluid communication with the vacuum fan/motor assembly. The handle assembly 12 pivots relative to the foot assembly 14 through a pivot axis that is coaxial with a motor shaft (not shown) associated with the vacuum fan/motor assembly. A mounting section 24 on the primary support section 16 of the handle assembly 12 receives a dirt separating and collecting system or dirt separation module assembly 26 according to a first embodiment of the invention.

The foot assembly 14 comprises a housing 28 with a suction nozzle 30 formed at a lower surface thereof and that is in fluid communication with the vacuum fan/motor assembly (not shown) within the motor cavity 20. While not shown, an agitator can be positioned within the housing 28 adjacent to the suction nozzle 30 and operably connected to a dedicated agitator motor, or to the vacuum fan/motor assembly within the motor cavity 20 via a stretch belt or other suitable coupling. Rear wheels 32 are secured to a rearward portion of the foot assembly 14 and a pair of support wheels (not shown) are secured to a forward portion of the foot assembly 14 for moving the foot assembly 14 over a surface to be cleaned.

Figure 2:
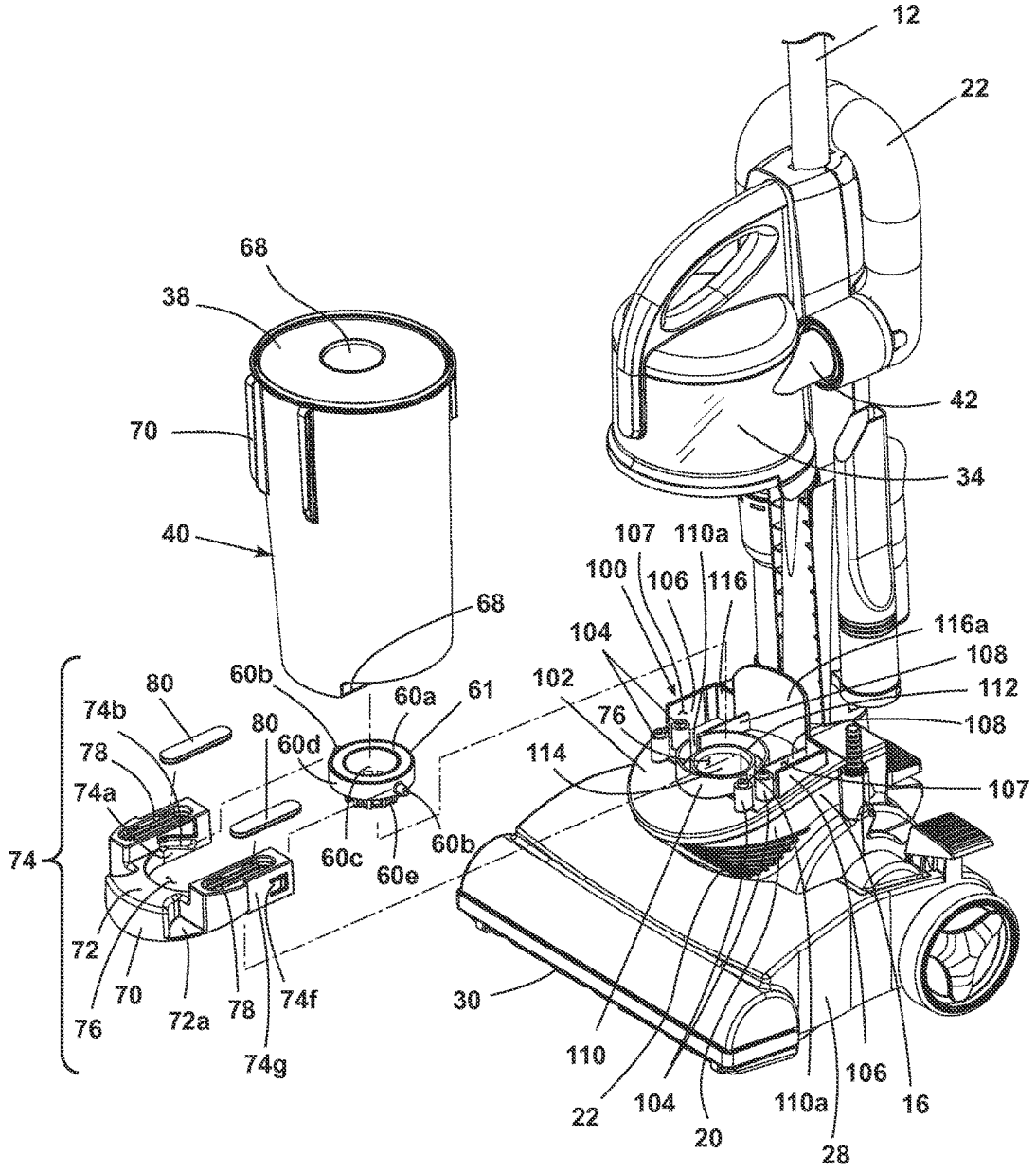
FIG. 2 is a partial exploded perspective view of the dirt separation module of FIG. 1.
Figure 3:
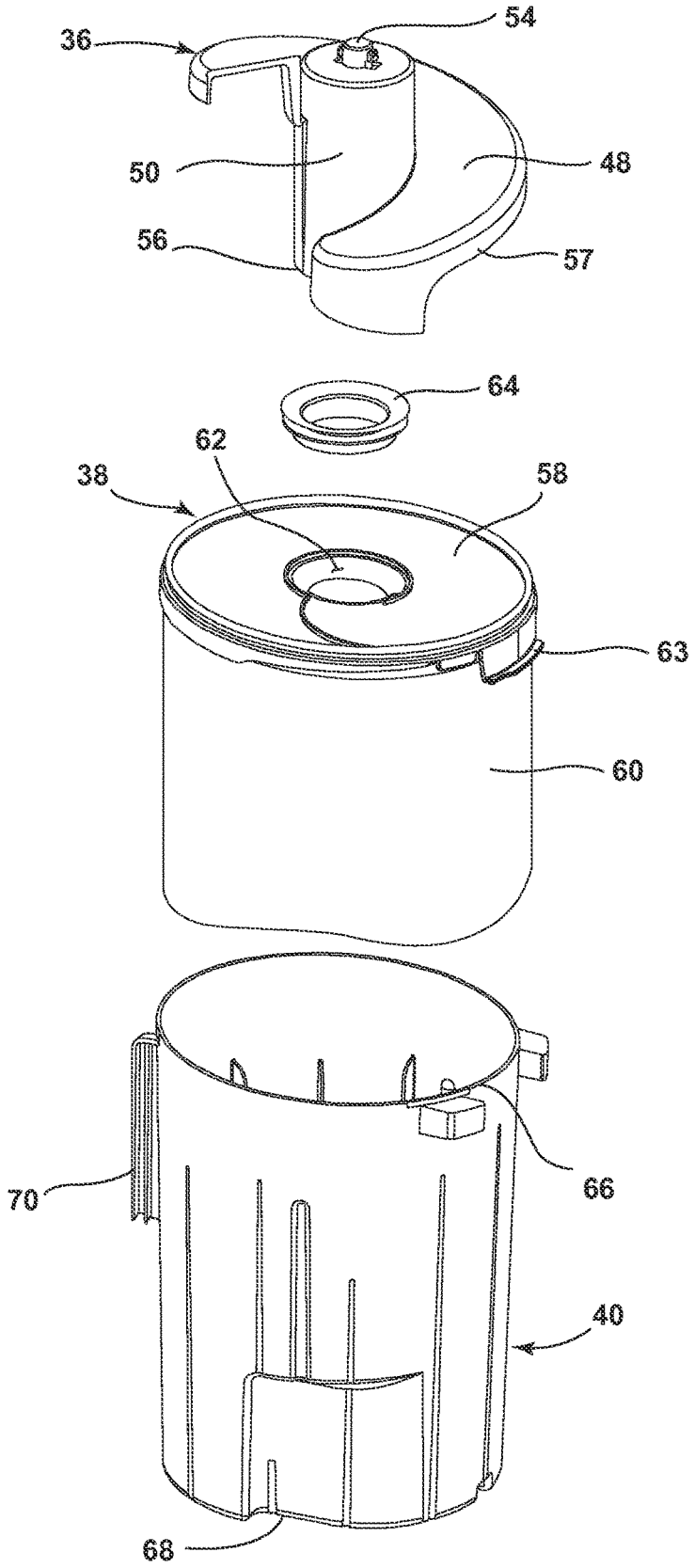
FIG. 3 is an exploded perspective view of the dirt separation module assembly of FIG. 1.

Referring to FIGS. 1, 2 and 3, the dirt separation module assembly 26 separates contaminants from a dirt-containing working airstream and comprises a cover 34, a helical inlet guide 36, an air permeable filter bag assembly 38, and a lower housing 40. The cover 34 can be transparent or alternatively contain a transparent portion or window that allows line of sight visibility to the helical inlet guide 36 contained therein. The lower housing 40 can be opaque to hide the filter bag assembly 38 from view during normal operation of the vacuum cleaner 10. The cover 34 and lower housing 40 can collectively define a housing having a chamber in which the helical inlet guide 36 and the filter bag assembly 38 are received. The cover 34 can be stationary, in that is not intended to be removed from the vacuum cleaner 10 by the user. The lower housing 40 can be removable, in that it is easily removed from the vacuum cleaner 10 by the user. Thus, the lower housing 40 can be removed from the vacuum cleaner 10 without removing the cover 34. This permits the filter bag assembly 38 to be selectively removed from the lower housing 40 without needing to remove the helical inlet guide 36 from the vacuum cleaner 10.

Figure 4:
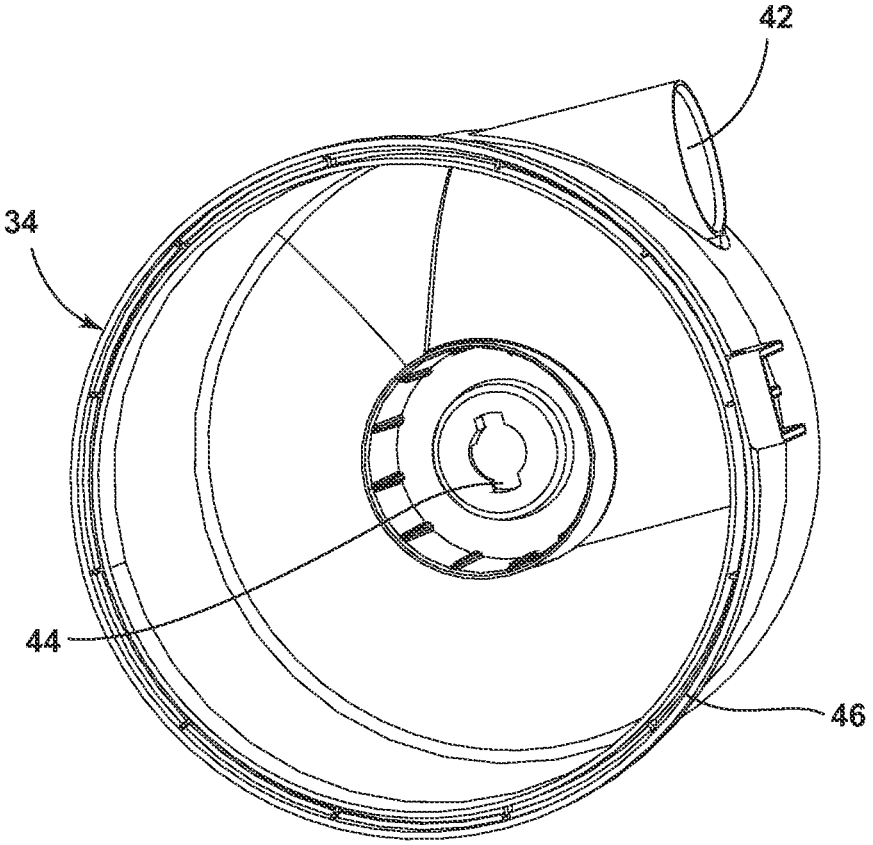
FIG. 4 is a perspective view of a cover of the dirt separation module of FIG. 1.

Referring to FIGS. 1 and 4, the cover 34 comprises a working air inlet 42 in fluid communication with the suction nozzle 30 of the foot assembly 14. A locking receiver 44 is centrally located on an upper surface of the cover 34 and is configured to receive an upper surface of the helical inlet guide 36. A cover sealing surface 46 is located at a lower portion of the cover 34 and engages with a mating surface on the housing 40.

Figure 5:
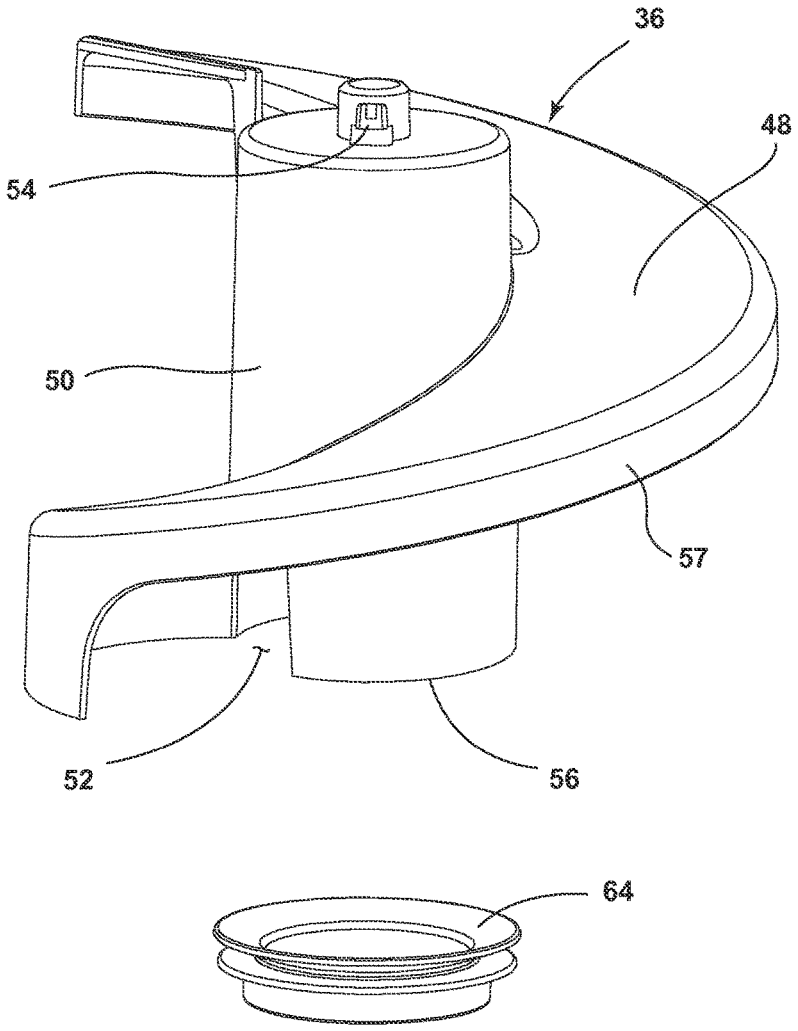
FIG. 5 is a perspective view of an inlet guide of the dirt separation module of FIG. 1.

Referring to FIG. 5, the helical inlet guide 36 comprises a generally spiral or helical ramp 48 around a center support structure 50 and terminates in an inlet guide outlet aperture 52. An upper portion of the center support structure 50 comprises an opposed pair of locking tabs 54 that interface with the locking receiver 44 (FIG. 4) to removably retain the inlet guide 36 to the cover 34. A mating surface 56 is located at a lower portion of the center support structure 50. Optionally, a downwardly depending lip 57 can be provided on the outer edge of the helical ramp 48. The lip 57 can help prevent dirt from leaking through the gap between the helical ramp 48 and the inner wall of the cover 34. The lip 57 can optionally be configured to seal against the sidewall of the cover 34.

Figure 6:
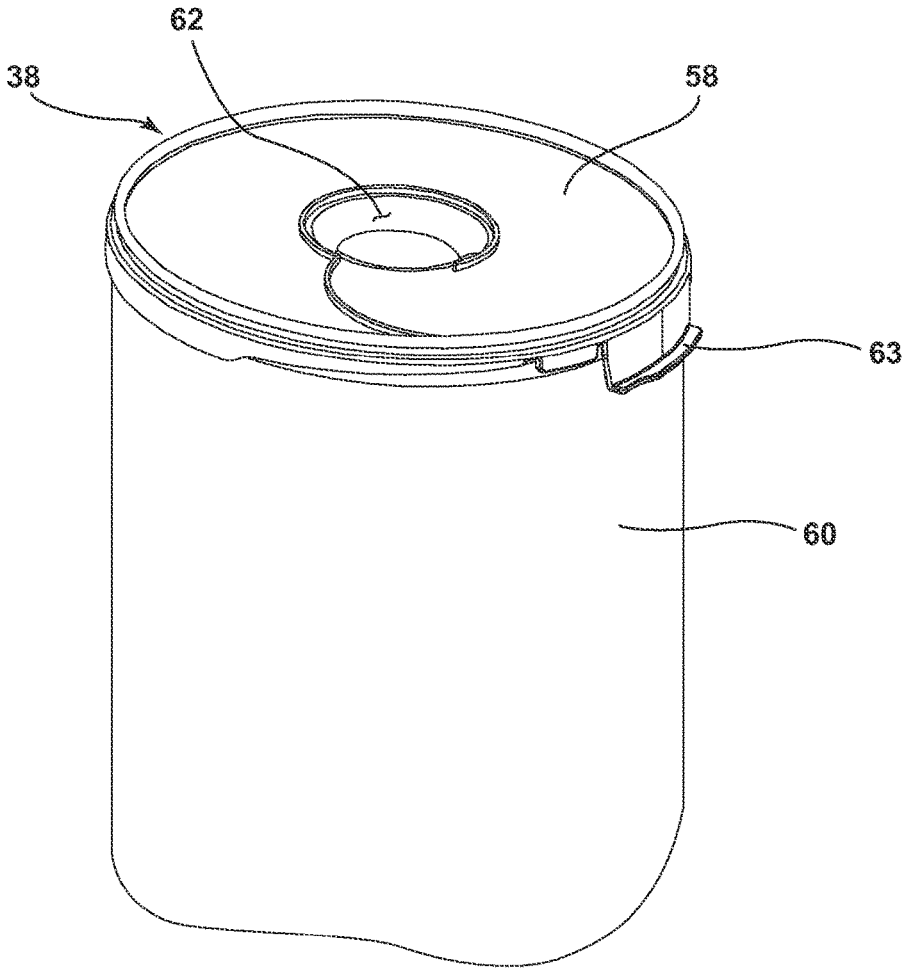
FIG. 6 is a perspective view of a filter bag assembly of the dirt separation module of FIG. 1.

Referring to FIG. 6, the filter bag assembly 38 comprises a rigid inlet guide interface structure 58 to which a permeable filter bag 60 is attached using a bonding means such as adhesives, stitching, staples, or other suitable means. The filter bag 60 may be flexible. A filter bag assembly working air inlet 62 is centrally located in the inlet guide interface structure 58 and is in fluid communication with the lower mating surface 56 of the inlet guide 36 (FIG. 5). Optionally, the interface structure 58 can comprise a release tab 63 which facilitates removal of the filter bag assembly 38 from the housing 40. When the housing 40 is separated from the vacuum cleaner 10, a user can grip the release tab 63 to lift the entire filter bag assembly 38 from the housing 40.

Moreover, although the figures show the inlet guide interface structure 58 mounted to the top edge of the housing 40 and thereby forming the sealing interface to the cover 34 when the filter bag assembly 38 is installed in the use position, this is for exemplary purposes only, and additional configurations are within the scope of the invention. For example, the interface structure 58 can be mounted within the housing 40, below the upper edge thereof, so that the upper edge of the housing 40 seals against the cover 34 during use. In yet another non-limiting example, the inlet guide interface structure 58 can be omitted altogether and the top of the filter bag 60 can be held between the housing 40 and the cover 34 and the upper edge of the housing can seal against the cover 34.

Referring to FIG. 3, a gasket 64 can be associated with either the inlet guide interface structure 58 or the lower mating surface 56 of the inlet guide 36 to fluidly seal the filter bag assembly 38 to the helical inlet guide 36. In the embodiment illustrated herein, the gasket 64 is removably attached to the inlet guide 36.

Figure 7:
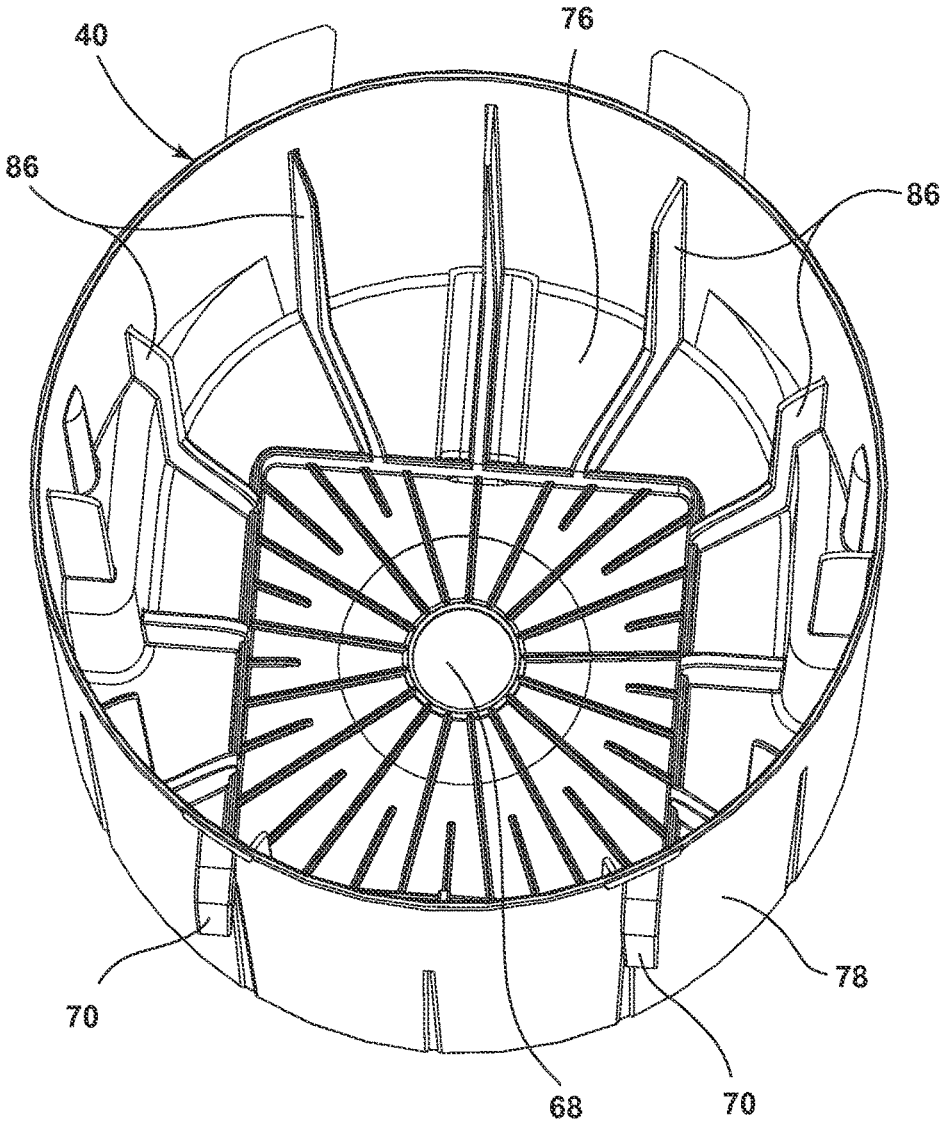
FIG. 7 is a perspective view of a filter bag housing of the dirt separation module of FIG. 1.
Figure 10:
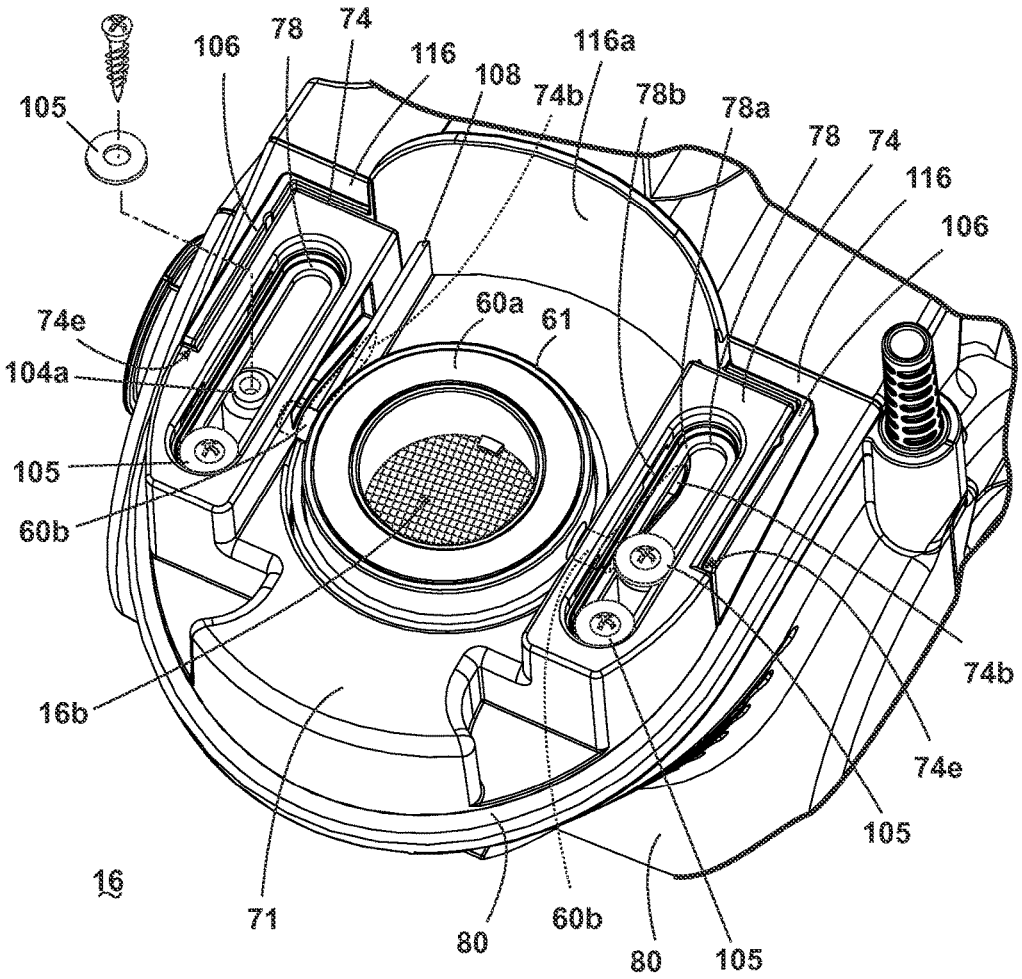
FIG. 10 is a perspective view of a filter bag housing latch assembly of the vacuum cleaner of FIG. 1.

Referring to FIG. 7, the housing 40 further comprises a generally cup-shaped structure having a bottom wall 76 and a side wall 78 extending upwardly from the bottom wall to an open top forming a sealing surface 66 at an upper surface of the side wall. A centrally located housing outlet grill 68 is located on the bottom wall 76 of the housing 40 and is in fluid communication with the permeable filter bag assembly 38 (FIG. 3). The filter bag assembly 38 is configured to removably insert in the interior of the housing 40 as will be described in more detail below. A filter bag housing grip 70 is located on an outer surface of the side wall 78. The housing outlet grill 68 is also in fluid communication with a motor inlet **16*b* located in the handle assembly 12 (FIG. 10). The housing 40 is removably retained by a latch assembly 74 in the handle assembly 12 (FIG. 2). The housing 40 may further include one or more vertical rib(s) 86 adjacent the bottom wall 76 and extending upwardly along the interior of the side wall 78. The rib(s) 86 may extend radially away from the side wall 78 toward the center of the housing 40, and function to support the bag assembly 38 and maintain a gap between the bag assembly 38 and the side wall 78 of the housing 40 during use. As shown herein, the ribs (86) are L-shaped, such that they also extend away from the bottom wall 76, thereby also maintaining the gap between the bag assembly 38 and the bottom wall 76 of the housing 40 during use. The gap forms a portion of the working air path between the bag 38 and the outlet 68. The ribs 86 can also support a portion the inlet guide interface structure 58**.

Optionally, the dirt separation module assembly 26 can be provided with a pre-motor filter assembly 80. The pre-motor filter assembly 80 can be provided within the housing 40 and may be positioned upstream of the housing outlet grill 68. In the illustrated embodiment, the pre-motor filter assembly 80 includes a pre-motor filter 82 comprising a conventional porous foam or non-woven filter material which covers the housing outlet grill 68, and a pre-motor filter frame 84 which covers and retains the pre-motor filter 82 within the housing 40. The filter frame 84 may be at least partially open to allow working air to pass through the filter frame 84 and filter 82. The filter frame 84 and filter 82 may be removable, in order to clean or replace the pre-motor filter.

Figure 8:
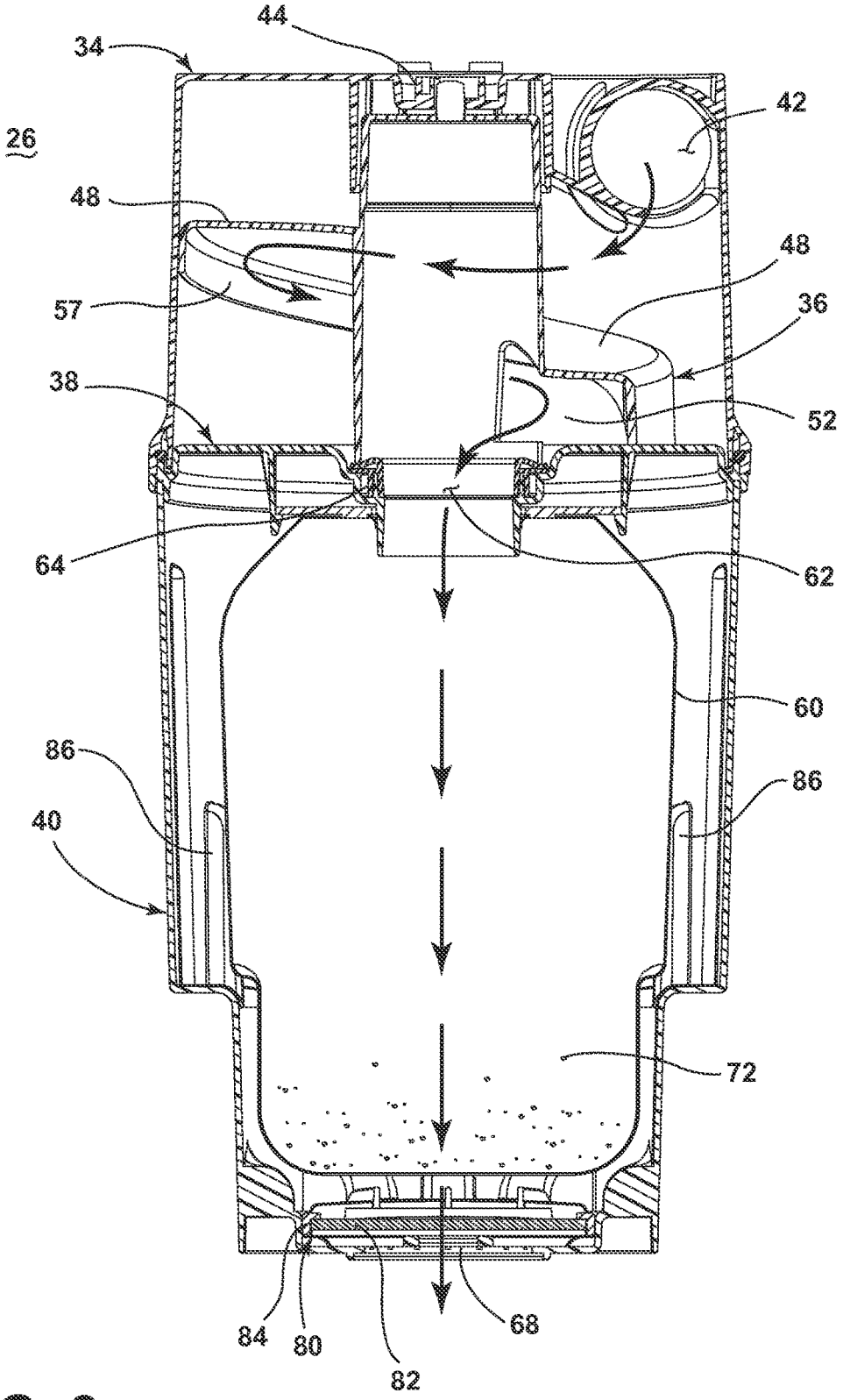
FIG. 8 is a cross-sectional view of a first bagged embodiment of the dirt separation module assembly taken through line VIII-VIII of FIG. 1 showing the flow path of working air through the dirt separation module assembly.

FIG. 8 shows a cross section of the dirt separation module assembly 26, with air flow through the assembly 26 depicted with arrows. Working air containing debris removed from the surface to be cleaned at the suction nozzle 30 (FIG. 1) is drawn into the working air inlet 42. Working air travels around and down the inlet guide center support structure 50 underneath the helical ramp 48 and down to the inlet guide outlet aperture 52 where it enters the filter bag assembly 38 through the filter bag working air inlet 62. Dirty air enters the interior of the filter bag assembly 38 where debris 72 is captured by the filter bag material 60. Filtered air passes through the filter bag material 60 and exits the housing 40 through the housing outlet grill 68 to enter the suction fan inlet 16*b* (FIG. 10). The helical ramp 48 in combination with a clear cover 34 allows the user to see dirt entering the filter bag assembly 38 during use.

Figure 9:
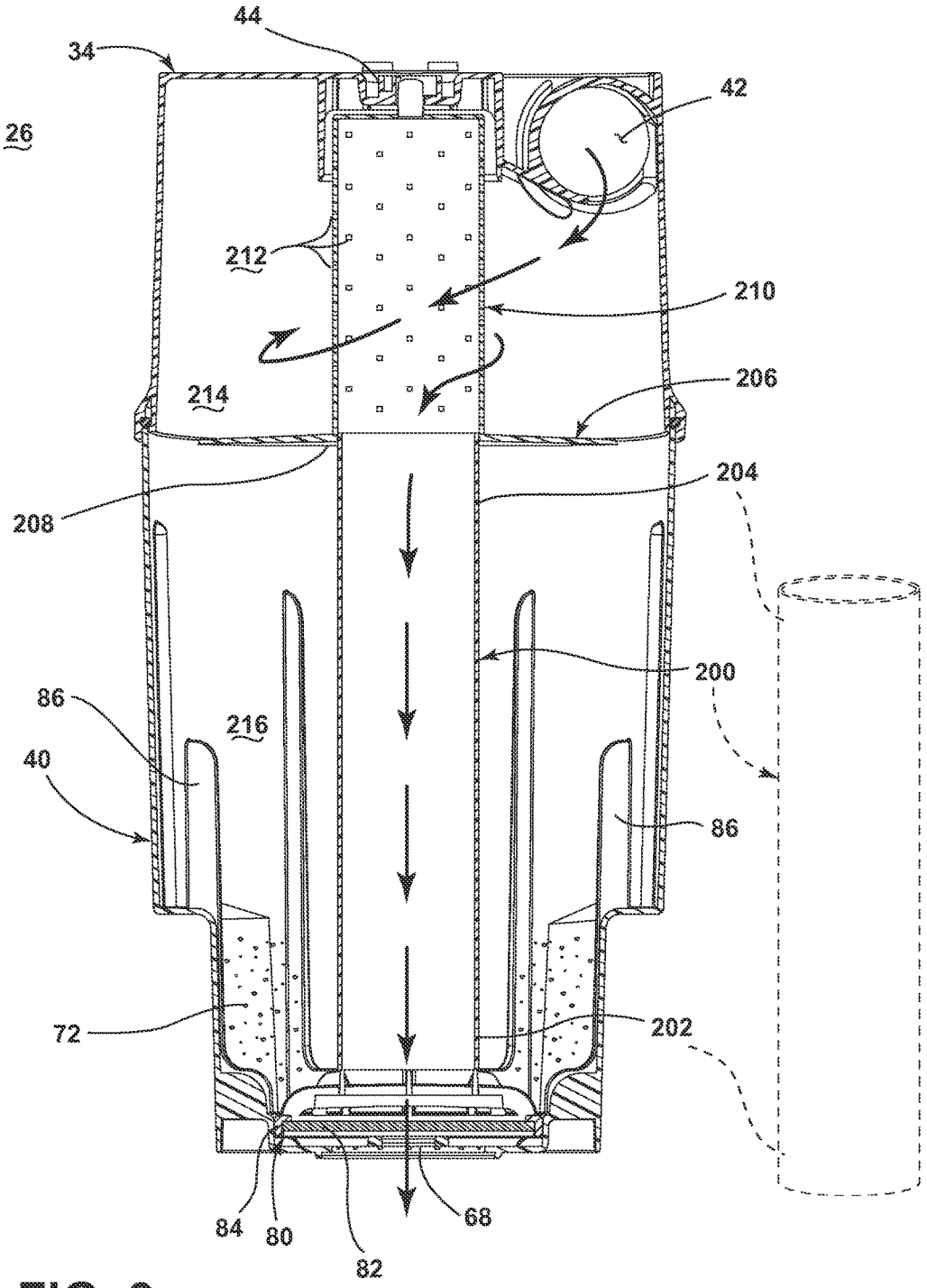
FIG. 9 is a cross-sectional view of a second, bagless configuration of the dirt separation module assembly of FIG. 1.

The helical inlet guide 36 and the filter bag assembly 38 are one example of a filter module which can be removably mounted within the chamber of the dirt separation module assembly 26 to separate dirt from a working air stream passing from the air inlet 42 to the air outlet 68. Other filter modules can be removably mounted within the chamber. The filter module shown in FIG. 8 is an example of a bagged filter module. FIG. 9 shows one example of a bagless filter module. The vacuum cleaner 10 can be part of a vacuum cleaner system having multiple, interchangeable filter modules. The filter modules can be alternatively mounted within the chamber and fluidly coupled with the air inlet 42 and the air outlet 68 to separate dirt from a working air stream.

An attachment mechanism can be provided for removably attaching the filter module to the dirt separation module assembly 26. As illustrated herein, the attachment mechanism is a bayonet mount that includes a female portion in the form of the locking receiver 44 located on the cover 34 and a male portion in the form of the locking tabs 54 located on a portion of the filter module. The locking tabs 54 are inserted into the locking receiver 44 and rotated ¼ turn to removably retain at least a portion of the filter module on the cover 34. It is understood that the male and female portions of the bayonet mount can be reversed on the filter module and cover 34. Other types of attachment mechanisms can be used, including threaded attachments, press-fits, snaps, clips, etc.

FIG. 9 is a cross-sectional view of a second configuration of the dirt separation module assembly 26. In the second configuration, the chamber defined by the cover and lower housing 40 receives a bagless filter module instead of the bagged filter module shown in FIG. 8. In the illustrated embodiment, the bagless filter module is a cyclonic filter module having a single separation stage. Other bagless filter modules are possible, and include a multi-stage cyclonic separator or a non-cyclonic, bagless separator. The bagless filter module illustrated herein can include a removable standpipe 200 and a centrifugal separator exhaust grill 210. The lower housing 40 can optionally be fitted with the removable standpipe 200 in place of the filter bag assembly 38 (FIG. 3) and with the exhaust grill 210 in place of the inlet guide 36. In solid line, the standpipe is shown positioned within the housing 40, while its removed position is indicated in phantom line. The standpipe 200 is a rigid tubular structure with a lower end 202 and an upper end 204. The lower end 202 of the standpipe 200 is removably press fit to the housing outlet grill 68 inside the housing 40. The standpipe 200, when installed, is flush or slightly below the housing 40 sealing surface 66 to allow the housing 40 to be removed from the handle 12, while leaving the cover 34 on the handle 12. The standpipe upper end 204 is sized to mate with a gasket 208 on a lower end of the centrifugal separator exhaust grill 210. The exhaust grill 210 comprises openings 212 through which air may pass into the standpipe 200, and a separator plate 206 to separate the cyclonic separation region 214 from the dirt collecting region 216. One example of a suitable grill 210 is shown in U.S. Pat. No. 7,708,789 to Fester, which is incorporated herein by reference in its entirety. Other suitable grills 210 may have perforations, holes, vanes, or louvers defining the openings 212. The exhaust grill 210 further includes an opposed pair of locking tabs 54 that interface with the locking receiver 44 (FIG. 4) to removably retain the exhaust grill 210 on the cover 34.

With this filter module, the rib(s) 86 in the housing 40 function to inhibit the vacillation of the debris deposited in the dirt collecting region 216 of the housing 40, thereby disrupting the currents that would tend to carry smaller dirt particles upwardly and back into the working air flow. The rib(s) 86 can also deflect dirt particles within the dirt collecting region 216 to further encourage agglomeration of the dirt particles within the housing 40.

In this embodiment, the vacuum cleaner 10 can easily be changed from a bagged separator, shown in FIG. 8 to a bagless separator, shown in FIG. 9, by simply removing the filter bag assembly 38 from the housing 40, inserting the standpipe 200 on the housing outlet grill 68, removing the helical inlet guide 36 from the cover 34 and replacing the helical inlet guide 36 with the exhaust grill 210.

Referring to FIGS. 2 and 10, the retention latch assembly 74 selectively raises and lowers the housing 40. Any number of known retention latches are suitable, including those disclosed in U.S. Pat. No. 7,191,490 to Lee et al., U.S. Pat. No. 6,732,406 to Oh, U.S. Pat. No. 6,735,816 to Oh et al., and U.S. Pat. No. 6,991,667 to Yang et al., incorporated herein by reference in their entirety. Another suitable description is found in U.S. Pat. No. 8,032,983 to Griffith et al., which is incorporated herein by reference in its entirety.

Referring to FIGS. 1 and 2, the housing 40 is removably retained on the handle assembly 12 by the latch assembly 74. When installed on the handle 12, the housing outlet grill 68 fluidly communicates with the motor inlet 16*b* within the handle assembly 12, through aligned housing outlet grill 68 and further through a bore 60*c* of an annular seal member 61 mounted on a housing base 100 on the handle 12.

As best shown in FIGS. 2 and 10, the housing outlet grill 68 rests on an upper sealing face 60*a* of the seal member 61. A lower end 60*e* of seal member 61 is in fluid communication with the motor inlet 16*b*. The seal member 61 is trapped for up-and-down movement on a collar structure 110, 112 around the motor inlet 16*b*. A generally U-shaped slide lock member 71 is mounted to slide generally horizontally in and out on the housing base 100 in a substantially straight path, in sliding contact with portions of the trapped seal member 61 to cam the seal member up and down.

To configure the dirt separation module assembly 26 for use as a bagged system, the slide lock member 71 is pulled out away from the handle 12 (forward) allowing the housing 40 to drop down below the cover sealing surface 46. The user grasps the housing 40 by the grip 70 and pulls the housing 40 out of the handle 12. The user then inserts the filter bag assembly 38 inside of the housing 40 so that the inlet interface structure 58 rests on a lip (not shown) adjacent the housing 40 sealing surface 66. With the housing 40 still removed, the inlet guide 36 is inserted into the cover 34 from below, and the locking tabs 54 are inserted into the locking receiver 44 and rotated ¼ turn to removably retain the inlet guide 36 on the cover 34. The housing 40 with the filter bag assembly 38 is then inserted into the handle 12 under the cover 34 and on the latch assembly 74. The user pushes in the slide lock member 71 (rearward), raising the housing 40 until the upper sealing surface 66 sealingly mates with the lower cover sealing surface 46. Simultaneously, the gasket 64 on the lower mating surface 56 of the inlet guide 36 seals the filter bag working air inlet 62 to provide working air flow through the dirt separation module assembly 26 as illustrated in FIG. 8. In use, as dirty working air is drawn through the vacuum cleaner, the clear cover 34 allows the user to see dirty air entering the filter bag assembly 38 around the helix inlet guide 36.

Alternatively, the user can employ the optional standpipe 200 and grill 210 to convert the vacuum cleaner 10 to a conventional bagless unit. In operation, a user pulls the slide lock member 71 out away from the handle 12 (forward) allowing the housing 40 to drop down below the cover sealing surface 46. The user grasps the housing 40 by the grip 70 and pulls the housing 40 out of the handle 12. The filter bag assembly 38 is removed from the housing 40. The user inserts the standpipe 200 over the housing outlet 68. The user then reaches up inside the cover 34, grasps the helical inlet guide 36, rotates the inlet guide 36 ¼ turn, and removes the helical inlet guide 36 from the top of the cover 34. The user then inserts the exhaust grill 210 in the cover 34 in reverse order. The housing 40 with the standpipe 200 is inserted into the handle 12 under the cover 34 and on the latch assembly 74. The user pushes in the slide lock member 71 (rearward), raising the housing 40 until the upper sealing surface 66 sealingly mates with the lower cover sealing surface 46. Simultaneously, the upper end 204 of the standpipe 200 sealingly engages the gasket 208 on the bagless cyclone exhaust grill 210 to provide working air flow through the dirt separation module assembly 26 as illustrated in FIG. 10.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims.

What is claimed is:

1. A vacuum cleaner comprising:

a body having a suction nozzle;

a dirt separating and collecting system provided on the body comprising:

a housing defining a chamber with an air inlet and an air outlet;

an air-permeable filter material removably mounted within the chamber to separate and collect dirt from a working air stream passing from the air inlet to the air outlet, the filter material fluidly disposed between the air inlet and the air outlet such that the working air stream passes through the filter material after passing through the air inlet and before passing through the air outlet; and a helical inlet guide disposed within the housing and directing the working air stream from the air inlet through the filter material along a helical pathway; and a suction source fluidly connected to the suction nozzle and to the air inlet for establishing and maintaining a dirt-containing working airstream from the suction nozzle to the chamber;

wherein the housing comprises a cover over the helical inlet guide and wherein the cover is at least partially transparent to permit the helical inlet guide to be viewed from the exterior of the vacuum cleaner; and wherein the air inlet is formed in the cover, separate from the helical inlet guide.

2. The vacuum cleaner of claim 1, wherein the helical inlet guide comprises a helical ramp and a lip provided on an outer edge of the helical ramp.

3. The vacuum cleaner of claim 2, wherein the cover comprises a sidewall, and the lip seals against the sidewall.

4. The vacuum cleaner of claim 2, wherein the air inlet is in fluid communication with an underside of the helical ramp, such that the working air stream passes underneath the helical ramp.

5. The vacuum cleaner of claim 1 and further comprising a pre-motor filter provided in the housing and fluidly connected between the filter material and the air outlet.

6. The vacuum cleaner of claim 1, wherein the cover comprises a stationary portion which contains the helical inlet guide and the housing comprises a removable portion below the cover which contains the filter material.

7. The vacuum cleaner of claim 6, wherein the removable portion is selectively removable from the vacuum cleaner without removing the stationary portion such that the filter material can be selectively removed from the chamber.

8. The vacuum cleaner of claim 7, wherein the removable portion is opaque.

9. The vacuum cleaner of claim 6, wherein the air outlet is formed in the removable portion.

10. The vacuum cleaner of claim 1, wherein the helical inlet guide is disposed between the air inlet and the air outlet such that the working air stream passes through the helical inlet guide after passing through the air inlet and before passing through the air outlet.

11. The vacuum cleaner of claim 10, wherein the dirt separating and collecting system comprises a filter bag comprising the air-permeable filter material, and wherein filter bag comprises a filter bag air inlet, and the helical inlet guide is sealed with the filter bag air inlet.

12. The vacuum cleaner of claim 1, wherein the housing comprises a bottom wall, and the air outlet is provided in the bottom wall.

13. The vacuum cleaner of claim 1, wherein the filter material is flexible.

14. The vacuum cleaner of claim 13 and further comprising a rigid inlet guide interface structure supporting the filter material.

15. The vacuum cleaner of claim 1, wherein the dirt separating and collecting system comprises a filter bag comprising the air-permeable filter material.

16. The vacuum cleaner of claim 15 and further comprising an inlet guide interface structure supporting the filter bag.

17. The vacuum cleaner of claim 16, wherein the inlet guide interface structure comprises a filter bag air inlet leading into the interior of the filter bag, and in fluid communication with the helical inlet guide.

18. The vacuum cleaner of claim 17 and further comprising a gasket between the inlet guide interface structure and the helical inlet guide to fluidly seal the filter bag with the helical inlet guide.

19. The vacuum cleaner of claim 15, wherein the housing comprises a bottom wall having an outlet grill defining the air outlet.

20. The vacuum cleaner of claim 1, wherein the cover comprises an upper surface and a sidewall, and further comprising a locking mechanism removably coupling the helical inlet guide to the upper surface of the cover.

* * * * *